United States Patent [19]

Gillio-tos et al.

[11] Patent Number: 4,611,456

[45] Date of Patent: Sep. 16, 1986

[54] PROCESS FOR MAKING A VACUUM SKIN PACKAGE AND PRODUCT FORMED THEREBY

[75] Inventors: Mario Gillio-tos, Rho Milan, Italy; Enzo Vassarotti, Bugneaux Sur Rolle, Switzerland; Henry G. Schirmer, Spartanburg, S.C.; Gottfried von Bismarck, Lutry, Switzerland

[73] Assignee: W. R. Grace & Co., Cryovac Div., Duncan, S.C.

[21] Appl. No.: 831,118

[22] Filed: Feb. 20, 1986

Related U.S. Application Data

[63] Continuation of Ser. No. 633,743, Jul. 23, 1984, abandoned.

[30] Foreign Application Priority Data

Aug. 23, 1983 [GB] United Kingdom ..... 8322662

[51] Int. Cl.[4] ..... B65B 11/52

[52] U.S. Cl. ..... 53/427; 53/449; 53/175; 156/287

[58] Field of Search ..... 53/427, 449, 173, 175, 53/509; 156/285, 287, 382

[56] References Cited

U.S. PATENT DOCUMENTS

| | | | |
|---|---|---|---|
| 3,358,829 | 12/1967 | Smith et al. | 53/427 |
| 3,694,991 | 10/1972 | Perdue et al. | 53/427 |
| 3,784,004 | 1/1974 | Meyer | 53/427 |
| 4,052,931 | 11/1977 | Morse et al. | 53/175 |
| 4,062,449 | 12/1977 | Popkes et al. | 53/427 |
| 4,200,481 | 4/1980 | Faller | 53/175 |
| 4,275,544 | 6/1981 | Hisuzumi et al. | 53/427 |
| 4,337,116 | 6/1982 | Foster et al. | 156/285 |

FOREIGN PATENT DOCUMENTS

| | | | |
|---|---|---|---|
| 2044726 | 3/1972 | Fed. Rep. of Germany | 53/427 |
| 2240234 | 3/1973 | Fed. Rep. of Germany | 53/175 |
| 0894827 | 4/1962 | United Kingdom . | |
| 1021494 | 3/1966 | United Kingdom . | |
| 1043214 | 9/1966 | United Kingdom . | |
| 1108718 | 3/1968 | United Kingdom . | |
| 1136885 | 12/1968 | United Kingdom . | |
| 1208466 | 10/1970 | United Kingdom . | |
| 1584759 | 2/1981 | United Kingdom . | |
| 1592376 | 7/1981 | United Kingdom . | |
| 2130166 | 5/1984 | United Kingdom . | |

*Primary Examiner*—John E. Kittle
*Assistant Examiner*—James J. Seidleck
*Attorney, Agent, or Firm*—John J. Toney; William D. Lee, Jr.; Mark B. Quatt

[57] ABSTRACT

The invention relates to a method of forming containers useful in vacuum packaging applications which require that the packaged product be wrapped in an air-impervious enclosure.

According to one aspect of the invention, the method comprises a step wherein a substrate of an air pervious, semipervious or impervious material is mold formed, and a subsequent step wherein an impervious film is applied on the molded substrate and adhered thereto to produce an impervious substrate. In another aspect, a product is placed on the impervious substrate and enclosed by an impervious film in a vacuum skin packaging process.

1 Claim, 9 Drawing Figures

PROCESS FOR MAKING A VACUUM SKIN PACKAGE AND PRODUCT FORMED THEREBY

This application is a continuation of application Ser. No. 633,743 filed on July 23, 1984, now abandoned.

This invention relates to a method of forming support or tray members for a vacuum package and particularly, forming a support member adaptable for vacuum skin packaging. Usually, in skin packaging processes a product on a support member is enclosed by a plastic film which conforms to the product like a skin and which is adhered to the supporting member. In vacuum skin packaging the film and supporting member are gas impervious and the space containing the product is evacuated.

In the general field of packaging, and in particular food product vacuum packaging, various methods are known which are directed to impart on the packaged products such features as unalterability with time, convenience of handling, and a capability to withstand careless handling and/or shocks.

Among others, this same Applicant disclosed, in EPC Application No. 83.300134.9, and Italian Patent Application No. 24264 A/82, filed on Nov. 15, 1982 some solutions to the problems of wrinkles forming during the application of the sealing film to the vacuum skin package and of the dimensional dependence of the container on the product which it is to accommodate.

With specific reference to Italian Patent Application No. 24264 A/82, the invention therein provides for the use of a sheet-like support material for the product to be packaged which support material is in a substantially tray-like configuration. The tray may be constructed from multilayered laminated films having adequate relative rigidity to enable the tray to be self-supporting.

The use of such types of material involves significant manufacturing costs because, in addition to the cost of molding the sheet-like element, there is the cost of first laminating the various layers making up the film, which cost becomes quite significant with materials of significant rigidity. Further, it should be considered that at the end of the packaging cycle, the containers presented at the packaging machine outlet in the form of a continuous web of side-by-side packages, must be separated from one another and, preferably, trimmed out.

In view of a multilayer film being used as the support member which preferably has a bottom layer which is pervious or semi-pervious to air, and a top layer which is formed by impervious films functioning as gas barriers, it may be appreciated how the otherwise needless presence of impervious film at those portions of the support member which are to be removed with the trimming operation, results in a wasteful use of materials; moreover, the use of multilayered laminated film disallows recycling of the flash resulting from said operation because the flash is composed of different materials.

In light of the above technical problems, it is a primary object of the invention to obviate such prior deficiencies by providing a method of forming containers particularly intended for vacuum skin packaging applications which affords the possibility of utilizing materials readily available commercially thereby eliminating the need for expensive additional steps of preliminary lamination.

A further object of the invention is to decrease the package manufacturing costs without a detriment to its sealing and vacuum holding capabilities.

Another object of the invention is to enable recovery of the flash resulting from the package trimming operation.

A not unimportant object of the invention is to accommodate supporting members of widely varying characteristics in accordance with the requirements of the types of products to be packaged and the kind of packages selected.

One aspect of the present invention provides a method of forming a support member for a vacuum packaging application, comprising the steps of mold forming a substrate from a thermoformable material, and applying an impervious film to the substrate by means of a pneumatic pressure difference.

The substrate is preferably a single layer of thermoformable material which may be either pervious, semi-pervious, or impervious to air; and the support member preferably may be shaped as a tray with upwardly extending walls. Preferred substrate materials are polystyrene, polypropylene, vinylidene chloride co-polymer, polycarbonate, acrylonitrile-based copolymers, and polyamides.

A second aspect of the invention provides a method of forming a tray-like support member for a vacuum packaging application, comprising shaping a substrate to have a floor and upwardly directed side walls, and then applying an impervious film to the substrate by means of a pneumatic pressure difference. The impervious film, also called the "first" impervious film, preferably has smaller dimensions than the substrate so that trim material can be recycled, and a saving in impervious material is effected. It is further preferred that the impervious film have at least one heat-weldable surface.

The invention also provides a vacuum package, preferably a vacuum skin package, constructed by placing a product on the support member of the first or second aspect and enclosing it between the first mentioned and a second impervious film sealed together in a hermetic seal, the space in which the product is enclosed having been evacuated.

Further features and advantages of the invention will be more clearly apparent from the following detailed description of a preferred, though not limitative, sequence of the tray forming steps with reference to the accompanying drawings, where:

FIG. 1 diagramatically illustrates, in section, the substrate forming step;

FIGS. 2 and 3 diagramatically illustrate, also in section, the steps of application of the impervious film on the substrate;

Figure 1:
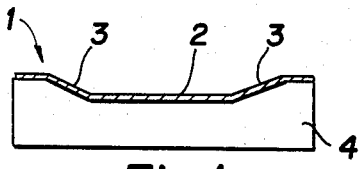

Making reference to the drawing figures, the first step of the inventive method comprises the forming, preferably thermoforming, in a manner known per se, of a material which may be either rigid or pliable or expanded, identified hereinafter with the general term of "substrate".

The cited substrate, generally indicated at 1, is shaped at a performing station into a preferably traylike configuration. To this aim, a suitable mold 4 for thermoforming applications may be used, wherein the substrate would assume the cited tray-like shape to define a bottom 2 from which the opposing sides extend as diverging walls 3. The inclination of the walls affords the possibility, as explained in Italian Patent Application No. 24264 A/82 above, filed by this same Applicant, of attenuating or even eliminating altogether the formation of wrinkles in the course of a subsequent step of application of an impervious film, as described more clearly hereinafter.

As for the material that may be used in the substrate construction, the single requisite is that it be a thermoformable material, whether rigid, or pliable, or expanded, or whether pervious, semi-pervious or impervious. The objects of the invention are preferably achieved by a single layer non-laminated material, although it would be possible to use—for special anticipated final uses—laminated multilayer materials as well.

For illustration purposes, among the preferred materials for the above cited operation, polystyrene, polyvinylchloride, polypropylene, polycarbonates, acrylonitrile-based copolymers, and polyamides such as Nylon 6, may be mentioned, taking care that the thickness of the material used be compatible with the drawing depth of thermoforming and the final characteristics expected of the package.

According to the invention, to the thusly formed substrate an impervious film 5 is applied which is caused to closely adhere on the substrate by means of a pneumatic pressure difference which can be, for example, a vacuum type of application process of the kind illustrated in Italian Patent Application No. 24264 A/82, and EPC Patent Application No. 83300134.9, and UK Patent No. 1307054. Adhesion of the impervious film on the substrate is achieved, as an example, by using such a film which has at least a heat weldable surface adjacent the substrate. A heat activated adhesive coating may be used to provide the heat weldable surface.

The capability of film 5 to form a gas barrier enables the substrate to be formed from a material which is pervious or semipervious to air where the purpose of the substrate is to perform package protecting and stiffening functions.

Figure 2:
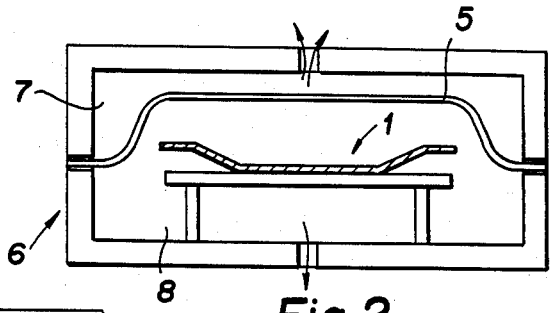

As shown in FIG. 2, both the impervious film and the substrate are contained in a vacuum chamber 6 having an upper portion 7 and lower portion 8. Preferably prior to being introduced into the chamber, the film is subjected to a preheating step, and a pneumatic vacuum is successively created in the upper portion of the chamber.

A pneumatic vacuum is similarly formed in the lower portion of the chamber. Next, air is admitted into the upper portion 7 to afford, as illustrated in FIG. 3, full adhesion of the impervious film on the substrate by means of the pneumatic pressure difference between upper chamber 7 and lower chamber 8.

Upon completion of this operation, the lower portion of the chamber is also restored to normal pressure conditions, thus producing a tray or supporting member 9 wherein the impervious film and substrate are totally adhered to each other.

Figure 4:
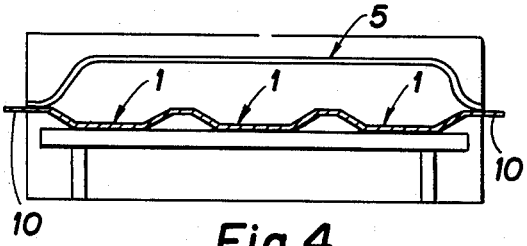
FIGS. 4 and 5 illustrate the same steps as FIGS. 2 and 3, but relating here to a substrate intended for simultaneously forming several containers.
Figure 6:
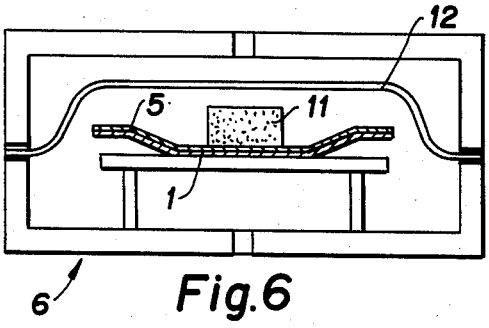
FIGS. 6 and 7 illustrate successive steps of one embodiment of this vacuum skin packaging method, wherein a sealing film is applied to a product on formed supporting member.
Figure 5:
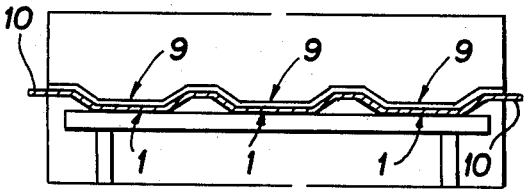
Figure 7:
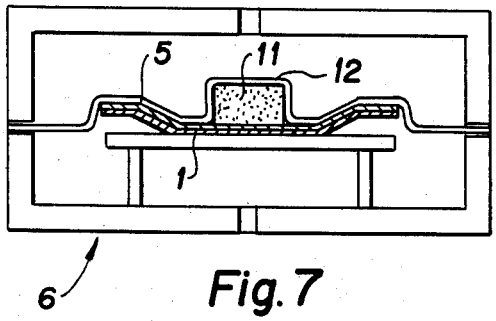
Figure 8:
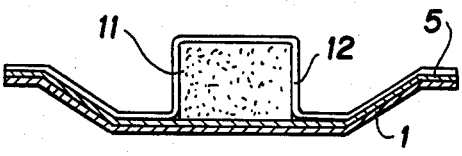
FIG. 8 is a diagramatic sectional view through a vacuum skin package according to the invention.
Figure 9:
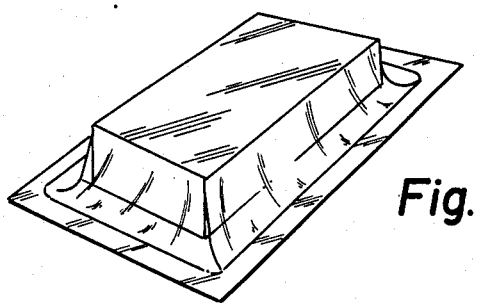
FIG. 9 is a perspective view of the finished package.

As shown in FIGS. 4 and 5, in commercial practice, it is also customary to simultaneously preform a number of trays laid side-by-side, which are then separated, following completion of the packaging operations, at a trimming station, not shown.

Figure 3:
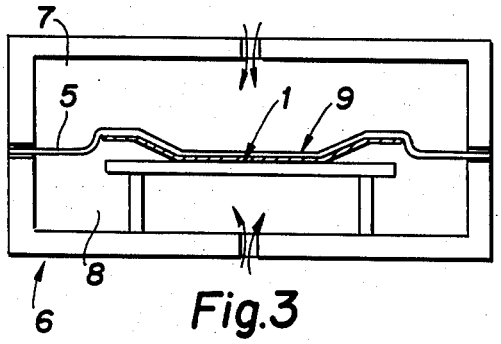

In order to move the trays to the various packaging steps, there is generally provided, both where the trays are sequentially arranged in a row as shown in FIGS. 2 and 3, and where they are arranged sequentially side-by-side as shown in FIGS. 4 and 5, a grip-enhancing edge 110 on either side of the web of sequentially arranged trays which is then cut at the trimming station.

That edge, being no part of the package, does not need to be covered with the impervious film. Thus, the inventive method affords the possibility of using the impervious film in smaller sizes than the effective width of the substrate, such width being adequate to just cover those areas which are necessary to provide an impervious support for product 111. Thus, the uncovered projecting areas at the substrate sides will form the grip-enhancing edges 10.

In addition to a saving in the material used to make the tray impervious, this enables flash to be obtained, as a result of cutting off of the grip-enhancing edges, which is uncontaminated by the presence of different materials, and hence suitable for recycling to the substrate manufacturing.

In the course of the cited impervious film application steps, the inclination of the walls 3 of the substrate prevents formation of wrinkles in the impervious film as the latter is adhered to the substrate.

Thus, the product packaging may then take place according to either of two alternative procedures: according to a first procedure, a product 11 would be laid onto the bottom portion of the tray 9 and again subjected to a vacuum treatment of the kind described above with application of a second impervious film 12 on the top surface of the product-tray assembly, said second impervious or gas barrier film 12 adhering on the film 5 and exposed surface of the product to seal and maintain the package in the condition of pneumatic vacuum.

It is important in this case that the surface of the film 5, at the areas of contact with the substrate, be sealable to the film 12 and develop a smaller force of adhesion on the film 12 than the adhesion force on the substrate. This is to prevent possible delamination or separation of the substrate and impervious film when the package is opened.

For this purpose, either film 5 or 12 should have heat welding properties at least across the contact surface provided. Thus, the impervious or gas barrier films 5 or 12 will be formed from any known material which can fulfil the required functions, the functions being that of a gas barrier and also being weldable to the adjacent films. As an example, laminated films may be readily used. Thus, the film 5 may be formed from a three-layer laminate, i.e. having two heat weldable outer layers and an intermediate barrier layer.

As an alternative, the inventive tray or support member may be used as a conventional thermoformed tray, e.g. filled with a product to be packaged, subjected preferably to a vacuum, and sealed with an impervious film welded to peripheral areas around the product.

The substrate may if desired be formed of cardboard and preferably is in the form of a blank defining several separate trays. Parts of the blank are stamped out to allow upward folding of those blank sections which will constitute the generally upwardly directed side walls of the finished tray, and because the cardboard is substantially non-extensible (as opposed to the thermoformable substrate material used for the support member illustrated in the drawings) the arrangement may be such that the folding operation involves not only lowering of the floor relative to the parts of the blank which will define the rim of a tray (or conversely raising of those rim portions relative to the floor) but also a mutual approaching movement of the floors to facilitate the upward folding of the side walls. Preferably the cardboard blank is of continuous web form in which case this relative approaching movement of the floors is both in the longitudinal direction of the web and in the transverse direction.

The desired approaching movement of the tray floors of the blank can be achieved by use of suction dies which are capable of drawing the floors vertically downwardly and horizontally so as to effect the lateral displacement simultaneously with the upward folding of the side walls. This same suction die can then be used to support the cardboard tray blank, consisting of one tray or a set of trays, in its erected configuration while the impervious covering film is welded to the concave face of each tray to give the erected tray blanks stability.

The formation of the tray blank will involve the provision of cut outs which close up as the side walls of the tray are erected, and these cut outs are then maintained closed by the heat-softened impervious film attached to the blank.

As with the thermoformed tray illustrated in the drawings, such a lined support member can be used for vacuum skin packaging simply by placing a product on the impervious film which has by now been attached to the substrate, and then covering the product and that film with a further impervious film by skin packaging techniques.

Throughout this specification we have referred to the "impervious film" as a barrier film which is impervious to air. Such a film preferably has an oxygen transmission rate of less than 450 ml/m$^2$/day/atm., preferably as low as 30 ml/m$^2$/day/atm. Such films are known in the art as "oxygen barrier films".

The invention as described is susceptible of many modifications and variations without departing from the scope of the instant inventive concept. In practising the invention, moreover, the materials used, as well as the dimensions and contingent shapes, may be any selected ones to meet the particular packaging requirements. For instance, the tray member, being gas impervious, may, within the strength limits of the substrate chosen form an outside wall for any package having an evacuated interior. Two trays of sufficiently rigid substrate material could oppose each other.

What is claimed is:

1. In the method of making a vacuum skin package having a substrate, a top film, and a product therebetween in a vacuum chamber, the improvement comprising the steps of:

(a) applying an impervious film to one surface of the substrate by means of pneumatic pressure difference; said impervious film having smaller dimensions than the dimensions of the substrate, the uncovered portion of the substrate forming grip-enhancing edges;

(b) placing the product to be package on said impervious film;

(c) positioning a top film over the product;

(d) evacuating the space between the top film and product;

(e) Forming the top film around the periphery of the product and into sealing contact with the impervious film on the substrate by means of pneumatic pressure; and (f) Trimming off the grip-enhancing edges which extend beyond the impervious film thereby producing a vacuum skin package.

* * * * *